United States Patent [19]

Wilson

[11] Patent Number: 4,927,112

[45] Date of Patent: May 22, 1990

[54] BLOWOUT PREVENTER

[75] Inventor: James A. Wilson, Dallas, Tex.

[73] Assignee: Doulbe-E Inc., Dallas, Tex.

[21] Appl. No.: 368,271

[22] Filed: Jun. 19, 1989

Related U.S. Application Data

[62] Division of Ser. No. 154,061, Feb. 9, 1988, Pat. No. 4,844,406.

[51] Int. Cl.[5] ..... E21B 33/06

[52] U.S. Cl. ..... 251/1.3; 277/129; 277/166

[58] Field of Search ..... 251/1.1, 1.3, 212; 277/30, 126, 127, 129, 166

[56] References Cited

U.S. PATENT DOCUMENTS 1,641,921 9/1927 Crowell ..... 277/129 X 4,690,411 9/1987 Van Winkle ..... 251/1.3 X

*Primary Examiner*—John C. Fox

*Attorney, Agent, or Firm*—Johnson & Gibbs

[57] ABSTRACT

A blowout preventer for use on wellheads for sealing around tubing strings, polished rods, and wirelines, including a body having a bore therethrough and connectable on a wellhead, integral laterally opposed side chambers in the body, a closure cap over each of the side chambers, an operating screw through each of the closure caps, a seal assembly in each of the side chambers adapted to come together in the bore of the body to seal off flow through the body, each of the seal assemblies including a ram plate having only an upper backup plate and side retainer walls, and an elastic seal supported on each ram plate below the backup plate inside the retainer walls, adapted to compress together within the ram body bore for expanding and extruding sufficiently to fully seal off the bore through the body.

7 Claims, 3 Drawing Sheets

BLOWOUT PREVENTER

This is a division of application Ser. No. 154,061 filed Feb. 9, 1988, U.S. Pat. No. 4,844,406.

FIELD OF THE INVENTION

This invention relates to well tools, and more particularly, relates to a device for installation on the tubing head at the top of a well to confine pressure in the well, and more commonly known in the industry as a blowout preventer. The invention further relates to seal assemblies for use in a blowout preventer. The blowout preventer of the invention is constructed to provide a seal at the upper end of a well about a tubing string, a polished rod, a wireline, and may also be used to close off the bore through the well head in the absence of any of the aforementioned members extending through the wellhead.

HISTORY OF THE PRIOR ART

It is a common and well known practice in the oil and gas industry to use wellhead devices which will confine pressure in a well around a member such a polished rod or wireline extending into a well during emergency conditions and when it is necessary to shut the well-in for servicing the well. A very wide variety of blowout preventers has been available for such purposes. Typical examples of prior art blowout preventers are shown in the following U.S. Pat. Nos. 2,194,255 and 2,194,256, issued to H. Allen on Mar. 9, 1940; 3,399,901, issued to M. L. Crow, et al. on Sept. 3, 1968; and 3,416,767, issued to L. Blagg on Dec. 17, 1968. Most such prior art devices have a complex combination of parts forming the ram seal assembly which are expensive to manufacture and difficult and expensive to service. In most such devices, the seal is clamped between plates or inserted into horizontal slots formed in a ram body. In both forms the servicing of the blowout preventer to replace the seal elements can present problems. In other forms of blowout preventers which are commercially available, the seal or packing is a solid compressible element having no backup plate. Such a device may more readily extruded under high pressures. In some of the available blowout preventers, the seal is bonded to the metal operating parts, and thus, cannot be replaced in the field. Additionally, certain available prior art devices used tapered external threads on the caps of the side ram cylinders, and install the caps without the use of o-rings. Such structure is inherently weaker and more subject to leakage.

SUMMARY OF THE INVENTION

It is an object of the invention to provide a new and improved blowout preventer.

It is another object of the invention to provide a blowout preventer which is more simple and less expensive to manufacture than presently available blowout preventers.

It is another object of the invention to provide a blowout preventer which is particularly useful for sealing around polished rods in pumping systems, wirelines, and tubing extending into and through a wellhead.

It is another object of the invention to provide a blowout preventer having seals which are easily replaced in the field.

It is another object of the invention to provide a blowout preventer having each seal mounted on a ram plate having a single upper backup plate.

It is another object of the invention to provide a blowout preventer having seals which are not bonded to the ram plates.

It is another object of the invention to provide a blowout preventer which will seal effectively to shut-in a wellhead when there is no member such as a wireline, tubing, or polished rod extending through the wellhead.

It is another object of the invention to provide a blowout preventer in which the seal is mounted on the ram plate with a backup plate of the ram plate above the seal and a lateral retainer wall portion along the outside face of the seal to restrain the seal against lateral expansion.

It is another object of the invention to provide a ram seal assembly for use in a blowout preventer.

It is another object of the invention to provide a blowout preventer which utilizes straight threads and an o-ring around the outer end of each of the rim plate chambers for securing and sealing with a cap at the outer end of each of the chambers.

In accordance with the invention there is provided a seal assembly for a well blowout preventer including a ram plate sized and shaped to slideably fit in a blowout preventer side chamber, the ram plate having only a top backup plate, an integral retainer side wall, and a seal coupling portion, and an elastic seal coupled with the ram plate below the backup plate within the retainer side wall, the seal overlapping the backup plate front edge and end edges of the backup plate and the retainer side wall, and means in the seal for attaching the seal with the ram plate.

BRIEF DESCRIPTION OF THE DRAWINGS

The foregoing objects and advantages and preferred embodiments of the invention will be understood from the following detail description taken in conjunction with the accompanying drawing wherein.

DETAILED DESCRIPTION OF THE PREFERRED EMBODIMENT

Figure 1:
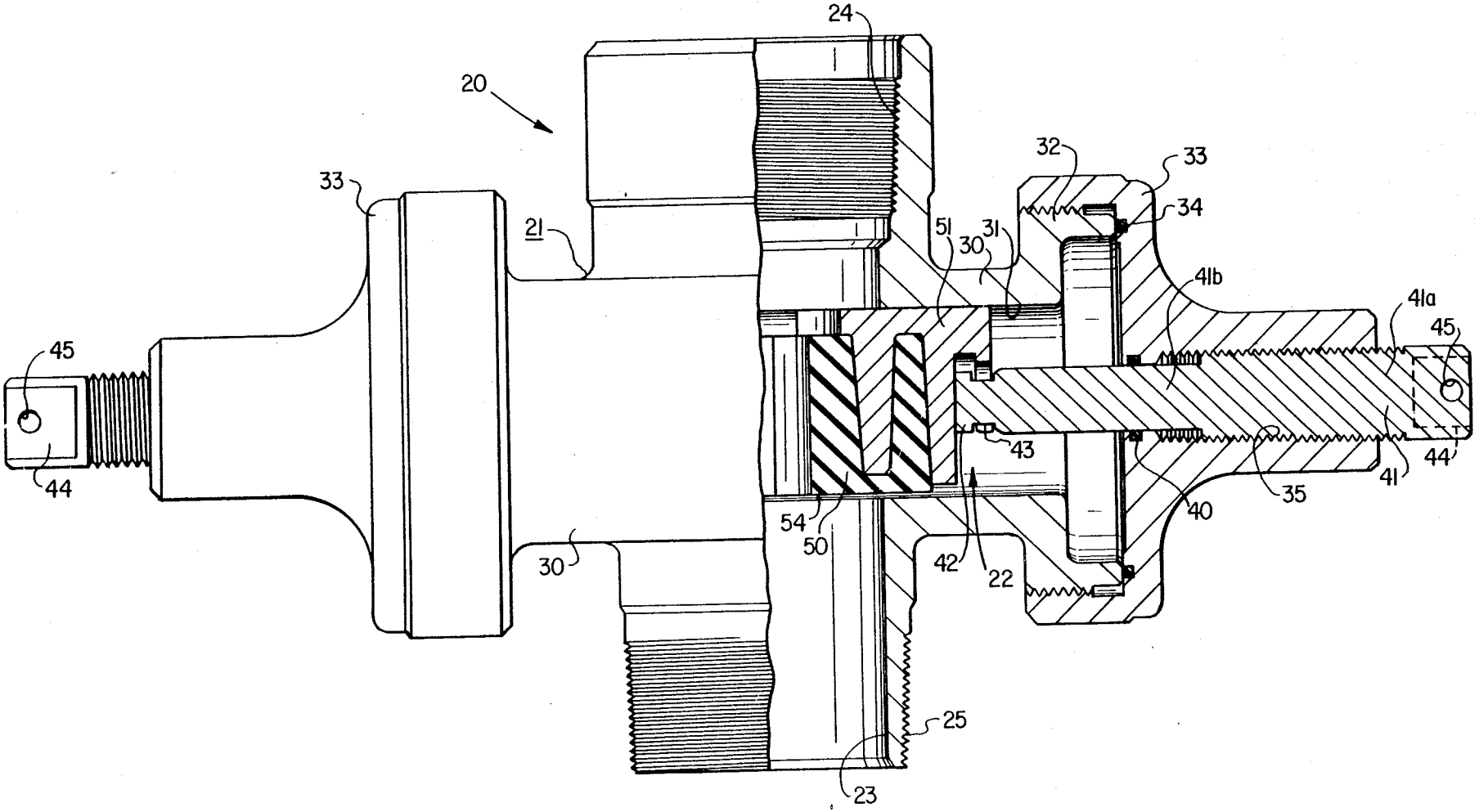
FIG. 1 is a side view in elevation, partially in section, of a blowout preventer showing the ram seal assemblies partially closed.
Figure 2:
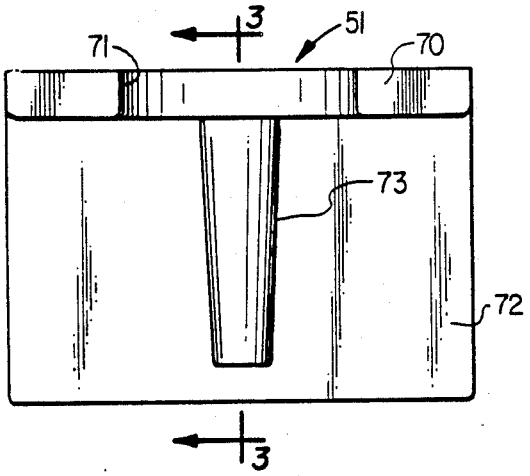
FIG. 2 is a left end view in elevation of the right ram plate shown in section in FIG. 1.
Figure 3:
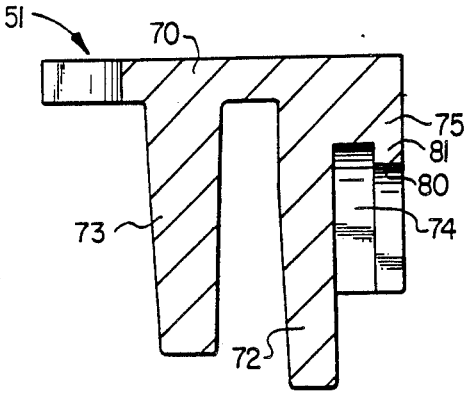
FIG. 3 is a view in section and elevation along the line 3—3 of FIG. 2, showing the right ram plate as illustrated in Fig. 1.
Figure 4:
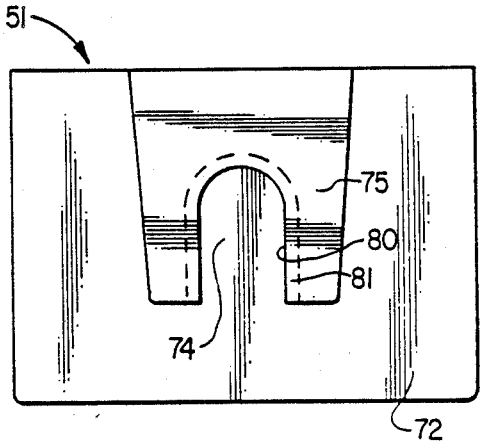
FIG. 4 is a right end view of the right ram plate illustrated in FIG. 1.
Figure 5:
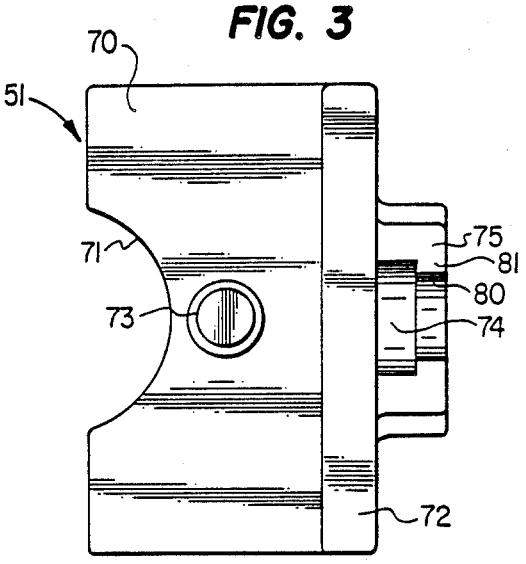
FIG. 5 is a bottom view of the ram plate of FIGS. 2—4 in the orientation shown in FIG. 1.

Referring to FIG. 1, a blowout preventer 20 embodying the features of the invention includes a body 21 and oppositely disposed ram seal assemblies 22 arranged to move together to shut-off flow through the body and to move apart to permit flow and well operations through the body. In operation, the body 21 is mounted on a wellhead at the upper end of a well as seen in FIG. 1 in U.S. Pat. No. 3,416,767 permitting access into the well and shutting in the well when necessary, either in the presence of or without apparatus extending into the well, such as a tubing, a polished rod, or a wireline.

The blowout preventer body 21 has a main bore 23 and upper internal threads 24 and lower external threads 25 at opposite ends thereof. The body is connectable by the threads 25 into a tubing head, not shown, or at the upper end of a tubing string at a wellhead as illustrated in FIG. 1 of U.S. Pat. No. 3,399,901. The body 21 has integral lateral ram body chamber portions 30 oppositely disposed with respect to the main bore 23 and opening into the main bore as seen in Fig. Each of the ram body chambers portion 30 has a chamber 31 opening into the body bore 23. Each chamber 31 is rectangular in cross section. One ram seal assembly 22 slidably disposed in each of the chambers 31 for movement together into the intersecting main bore 23. Each of the body portions 30 has an externally threaded circular end flange 32 for the mounting of closure cap 33 which closes the open end of each of chambers 31. The cap as seen in FIG. 1 is internally threaded to engage the external threads on the end flange 32. An o-ring seal 34 in an internal annular recess in the cap 33 seals between the end face of the flange 32 and cap. The end cap has a central internally threaded bore 35 and an o-ring seal 40 mounted within an internal annular recess in the cap around the bore 35 inward of the bore threads.

Additional well equipment above the blowout preventer may be connected in a wellhead by attachment at the threads 24 as illustrated, for example, in U.S. Pat. No. 3,399,901 and in U.S. Pat. No. 3,416,767, wherein apparatus is shown for directing a wireline into a well through the blowout preventer.

As illustrated in FIG. 1, the ram seal assemblies 22 are each coupled with an operating screw 41 having an enlarged outer end portion 41*a* which is externally threaded to engage the internal threads along the cap bore 35 for operating the screws 41 inwardly to close the blowout preventer and outwardly to open the preventer. The screws 41 each has a reduced unthreaded or smooth inward end portion 41*b* extending into the ram chamber 31 through the o-ring 40 which seals around the screw within the cap 33. Each of the operating screws 41 has an inward end flange 42 and an annular coupling recess 43 adjacent to the flange 42 to permit coupling the inward end of the screw 41 with the ram seal assembly 22. The outward end of each of the screws 41 is provided with flat opposite side faces 44 and a lateral pin hole 45 for the connection of an operating handle on each screw, such as the handles 58 shown in U.S. Pat. No. 3,399,901. The handles are used to rotate the screws 41 to open and close the ram seal assemblies.

Figure 6:
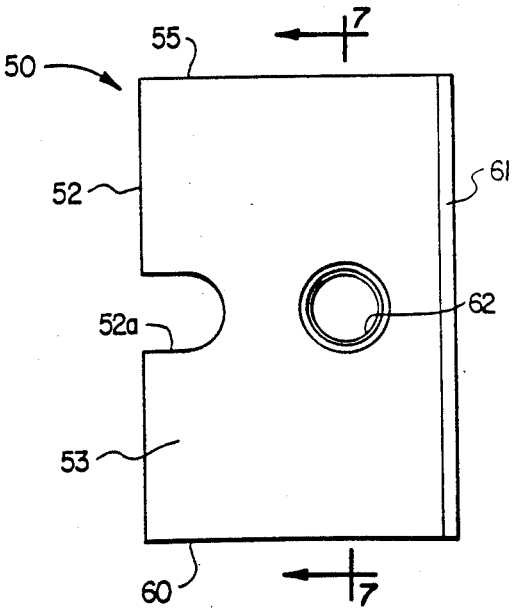
FIG. 6 is a top view of the ram plate seal or rubber in the orientation of FIG. 1 with the seal removed from the ram plate.
Figure 7:
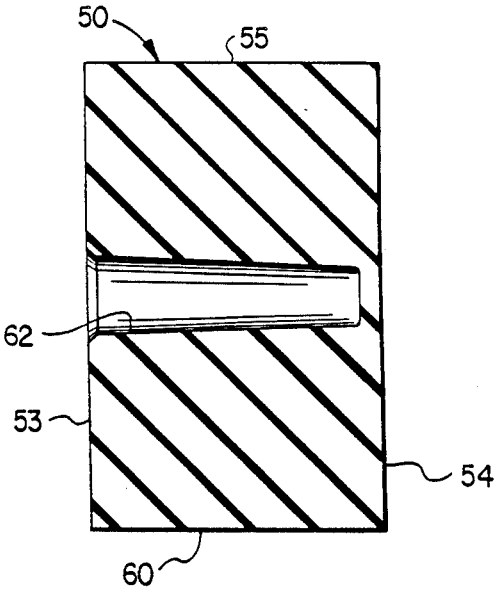
FIG. 7 is a view in section along the lines 7—7 of FIG. 6 of the ram plate seal.
Figure 8:
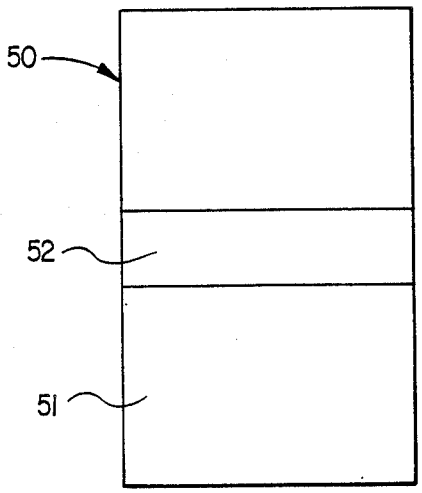
FIG. 8 is a left inside end view of the ram plate seal of FIGS. 6 and 7, showing the semi-cylindrical recess in the seal for engagement with a member such as a polished rod, pipe, or wireline through the wellhead.
Figure 12:
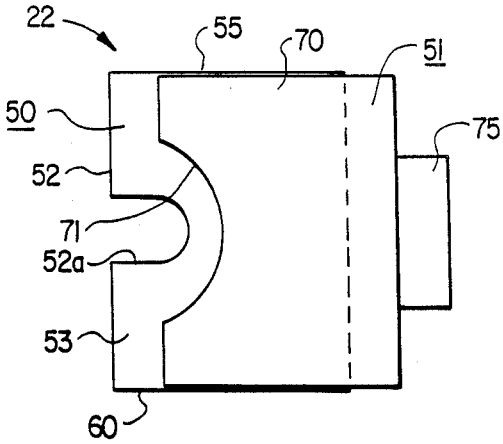
FIG. 12 is a top plan view of the right ram seal assembly illustrated in FIG. 1, showing the relationship between the ram plate and the ram seal.

Each of the ram seal assemblies 22 includes a ram seal or a rubber 50 and a ram plate 51, shown in assembled relationship in FIGS. 1 and 12, and separately in FIGS. 2–8. The ram rubber or seal 50 is illustrated in detail in FIGS. 6–8. The ram plate 51 is shown in detail in FIGS. 2–5. Referring to FIGS. 6–8, the seal 50 has a flat inside vertical seal surface 52 and is provided with a vertical semi-cylindrical recess 52*a* opening into the body of the seal through the seal surface 52 extending vertically perpendicular to the top and bottom faces 53 and 54 of the seal. The top and bottom surfaces 53 and 54 are parallel surfaces aligned perpendicular to the front seal face 52 of the seal. The seal 50 has opposite end faces 55 and 60 which are oriented parallel with each other and perpendicular to the front face 52 and the top and bottom faces 53 and 54. The outside or back vertical face 61 opposite the front seal face 52 slops upwardly toward the front face as evident in FIGS. 1 and 6. The seal is provided with a coupling or locking socket 62 which is a downwardly extending tapered hole running from the top face 53 along a vertical axis, not shown, which is aligned perpendicular to the top and bottom faces 53 and 54 of the seal. The socket 62 is centrally located relative to the end faces 55 and 60 and lies substantially half way between the recess 52 and the back sloping face 61 of the seal.

Referring to FIGS. 2–5, the ram plate 51 has a top backup plate portion 70 provided with a semi-circular front recess 71 and a dependant side retaining wall portion 72. An integral pin 73 depends from the approximate center of the backup plate 70 for engagement in the socket 62 of the seal 50 for holding the seal on the backup plate. As evident in FIGS. 3 and 5, the pin 73 is spaced from and forward of the retainer wall 72. A downwardly and rearwardly opening socket 74 is formed on the backup plate 51 to receive the flange 42 on the inward end portion of the operating screw 41 for coupling the backup plate assembly with the operating screw to permit the screw to open and close each of the backup seal assemblies. The socket 74 is defined by a downwardly extending integral portion of the backup plate 75 having a downwardly opening recess 80 defined by a flange 81 extending around the recess 80 along the back face of the portion 75 spaced from the back face of the wall 72 to define the socket 74. The inward end portion of the operating screw 41 fits in the recess 80 with the flange 42 of the screw end portion being positioned in the socket 74 so that the flange portion 42 on the screw is within the socket 74 inside of the flange 81, thereby coupling the screw with the backup plate.

The relationships between the seal 50 and the backup plate 51 are best seen FIGS. 1 and 12. The width of the seal 50, that is the long dimension of the seal as shown in the views of FIGS. 6 and 7 and perpendicular to the plane of FIG. 1 is greater than the diameter of the preventer body bore 23 and is greater than the corresponding long dimension of the backup plate. Further, the inside face of the seal, that is the face defined by the surface 52 and the semicircular recess 52 is positioned inwardly, as evident in FIG. 12, from the corresponding inside edges of the top portion 70 of the backup plate and the edge defining the recess 71. The inward overlap of the seal from the backup plate is sufficient that when the opposing ram seal assemblies are brought together within the bore 23, the inside faces of the confronting seals 50 extending inwardly from the ram plates will compress sufficiently to fully seal off the bore, whether a polished rod, wireline, or the like, is present or not within the bore. In other words, the extension of the inside portion of the seals from the ram plates must be sufficient that if the ram assemblies are brought together around a polished rod, the seals will fully close off the body bore around the polished rod, and when the assemblies are brought together with nothing present in the bore, the seals will also compress sufficiently to fully seal off the body bore.

Figure 9:
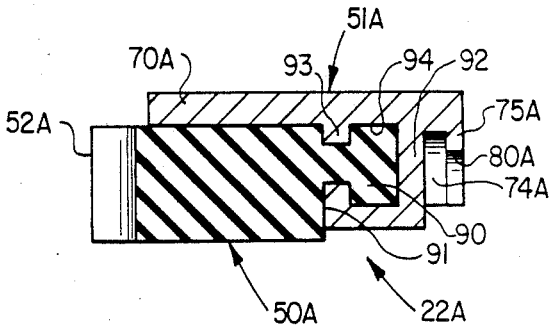
FIG. 9 is a side view in section and elevation of another form of the ram plate and ram plate seal in the orientation of the assembly illustrated in FIG. 1.
Figure 10:
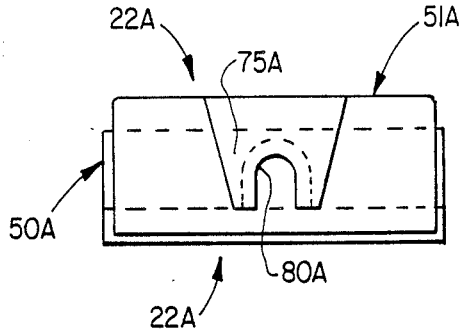
FIG. 10 is a right end view in elevation of the ram seal assembly shown in FIG. 9.

Referring to FIGS. 9 and 10, an alternate form of ram seal assembly 22A includes a ram seal 50A and a ram plate 51A. In FIGS. 9 and 10, the same reference numerals are used as in FIGS. 1–8 with the suffix "A" identifying similar features as in the ram seal assembly 22. For different features not present in the seal assembly 22, new reference numerals are applied. Referring to FIG. 9, the ram seal 50A has a lateral retainer portion 90, which is a T-shaped integral portion of the seal formed across the back face 91 of the seal, for engagement with the ram plate to hold the seal coupled with the ram plate. As also evident in FIG. 9, the ram plate 51A has a dependant lateral portion 92 which is shaped along with a lateral flange portion 93 across the bottom face of the plate to define a T-shaped lateral slot or recess 94 which is shaped to receive the T-shaped retainer portion of the seal 50A coupled with the ram plate 51A. As evident in FIGS. 9 and 10, the ram plate 51A has a downwardly and rearwardly opening socket 74A on the back face of the ram plate for connection of the inward end of the operating screw 41 with the ram plate in the arrangement illustrated in FIG. 1. The size relationships between the seal 50A and the ram plate 51A are substantially identical to those between the seal 50 and ram plate 51 as represented in FIG. 12.

Figure 11:
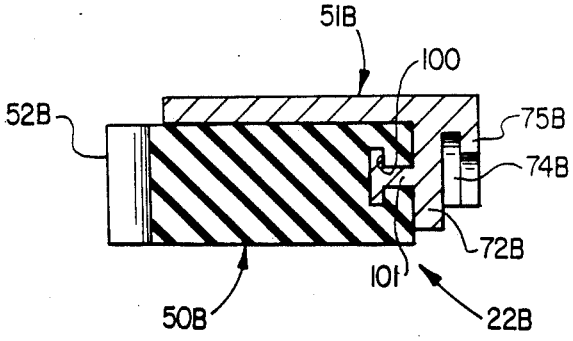
FIG. 11 is a side view in section and elevation of still another form of ram seal assembly in the orientation of FIG. 1.

Referring to FIG. 11, still further form of ram seal assembly 22B includes a ram seal 50B mounted on a ram plate 51B. the same reference numerals with the suffix "B" being used to identify similar features of the seal and ram plate as used in the previous figures. The seal 50B has a lateral T-shaped slot or recess 100 extending the width of the seal opening through outside back face of the seal. The ram plate 51B has a T-shaped lateral flange formed across the front sidewall portion of the ram plate 72B sized to fit in the T-shaped slot 100 of the seal. The T-shaped flange 101 holds the seal 50B on the ram plate. The other features of the ram plate 51B are identical to the ram plates 51 and 51A. The seals 50, 50A, and 50B are preferably formed of an elastic material capable of withstanding the pressures and chemicals to which the seals are subjected in an oil and gas well. The seals preferably are made of nitrile rubber having a hardness range of 40–95 durometers. It has been found that seals made of 60 durometer rubber and designed for sealing around a rod of 1 ½ inches in diameter will effectively seal when no tubing or wireline is present through the blowout preventer body, as well as seal around a tubing or wireline up to 1 ½inches diameter. It may also be desirable to form the seals of a material which has greater resistance to well fluids and well bore environment than nitrile rubber. Each of the seals is mounted on the respective ram plate held in position by the particular interlocking relationship between the seal and the ram plate. For example, the seal 50 is held on the ram plate 51 by the retainer pin 73 engaged in the retainer pin socket 62 of the rubber 50. Similarly, the seal 50A and 50B are held on the ram plates 51A and 51B, respectively, by the interlocking relationships illustrated in FIGS. 9 and 11. A particularly important feature of the invention is that the seals are not bonded to the ram plates. This feature permits quick and easy replacement of each of the seals on the respective ram plate in the field at the site of the blowout preventer.

In operation, the blowout preventer 20 is installed on a wellhead in the relationship illustrated in FIG. 1 of U.S. Pat. No. 3,416,767. The equipment connected into the bore threads 24 at the upper end of the body 21 is dependent upon the services to be performed through the blowout preventer. If a wireline operation is to be performed in the well, the equipment may resemble that shown in the reference patent. If the well is to be pumped, a pumping jack, not shown, is installed on the wellhead above the blowout preventer, with the polished rod of the pump extending through the blowout preventer. When installing the blowout preventer on a wellhead, the bore 23 through the preventer is opened by retracting the seal assemblies 22 by means of the operating screws 41 which are rotated to move the ram plates 51 with the connected seals 50 outwardly into the two side chamber spaces 31. When closure of the bore through the blowout preventer is desired, the ram screws 41 are rotated threading the screws inwardly forcing the seal assemblies 22 toward the center line of the blowout preventer body bore 23. If a pump polished rod is present through the bore 23 the ram seal assemblies moving from the two opposite chambers close around the polished rod with the seal recess 52A of each of the seals fitting around the polished rod and the seals coming together along the inside vertical faces 52 of the seals. The two seal assemblies are driven together by the screws 41 to the maximum extent possible forcing the seals 50 to expand extruding the seal material filling all of the voids within the chambers 31 around the ram plates to effectively and completely seal all communication upwardly through the bore 23 below the engaged seal assemblies.

When a seal is no longer required through the bore 23 of the blowout preventer body, the ram screws 41 are rotated in the opposite direction causing the screws to move outwardly in opposite directions retracting the seal assemblies 22 into the side chambers 31 until the socket portion 75 of each of the ram plates engages the inside face of the cap 33 on each side of the blowout preventer body. Each of the ram assemblies including the ram plates 51 and the seals 50 are fully retracted into the chambers 31.

At such time as it is necessary to service the blowout preventer 20, each of the seal assemblies 22 may be removed from the body 21 by unscrewing the caps 33 from the flanges 32. Preferably, when removing the seal assemblies, the assemblies are retracted as far as possible into the side chambers using the screws 41 before removing the caps 33. With the seal assemblies removed from the blowout preventer body, the seals 50, 50A, or 50B, are easily disengaged from the ram plates, which may be the plates 51, 51A, or 51B, because the seals are not bonded to the ram plates. New rubber seals are placed on the ram plates and the seal assemblies are reinstalled in the blowout preventer body as illustrated in FIG. 1. When replacing the seals, it also generally, would be preferable to replace the o-rings 34 and 40.

It will be seen from the foregoing description and the drawings that the blowout preventer is very simple in construction, has a minimum number of parts, and is readily serviceable in the field, due to the ease with which the seal assemblies may be removed, the seals replaced, and the assemblies reinstalled in the blowout preventer body.

What is claimed is:

1. A seal assembly for a blowout preventer comprising:

a ram plate adapted to slideably fit in a blowout preventer body side chamber including only a substantially rectangular top backup plate, an integral retainer sidewall dependant from said backup plate, and a dependant pin secured at a top end to said top backup plate spaced in front of said retainer sidewall; and an elastic seal substantially rectangular in horizontal cross section coupled with said ram plate below said backup plate within said retainer sidewall, said seal overlapping a front edge of said backup plate and opposite end edges of said backup plate and said retainer sidewall, and a socket in said seal opening from a top face thereof and spaced from a back edge of said seal and sized and shaped to receive said dependant pin on said ram plate for attaching said seal on said ram plate.

2. A seal assembly for a blowout preventer in accordance with claim 1 wherein said dependant pin is tapered from an upper end to a lower free end, and said socket in said elastic seal is tapered to receive said tapered pin.

3. A seal assembly for a blowout preventer in accordance with claim 2 wherein said retainer side wall has a substantially planar front face sloping upwardly toward said mounting pin.

4. A seal assembly for a blowout preventer in accordance with claim 3 wherein said seal and said retainer side wall are substantially rectangular in vertical planes.

5. A seal assembly for a blowout preventer in accordance with claim 4 where said seals are nitrile rubber having a hardness in the range of 40–95 durometer.

6. A seal assembly for a blowout preventer in accordance with claim 4 where said seal is formed of nitrile rubber of a hardness of approximately 60 durometer.

7. A seal assembly for a blowout preventer in accordance with claim 4 wherein said seal is of a material having greater resistance to well fluids and environment than does nitrile rubber.

* * * * *